US006105668A

United States Patent [19]

Schwarz et al.

[11] Patent Number: 6,105,668

[45] Date of Patent: Aug. 22, 2000

[54] STACKING-DISK HEAT EXCHANGER

[75] Inventors: Gebhard Schwarz, Stuttgart; Gerd Schleier, Schwaikheim, both of Germany

[73] Assignee: Behr GmbH & Co., Stuttgart, Germany

[21] Appl. No.: 09/144,998

[22] Filed: Sep. 1, 1998

[30] Foreign Application Priority Data

Sep. 10, 1997 [DE] Germany ..... 297 16 257 U

[51] Int. Cl.[7] ..... F28F 3/08

[52] U.S. Cl. ..... 165/916; 165/166; 165/167; 123/41.33; 123/196 AB

[58] Field of Search ..... 165/916, 167, 165/119, 134.1; 123/196 AB, 198 E; 184/104.1, 104.2, 104.3

[56] References Cited

U.S. PATENT DOCUMENTS

| | | | |
|---|---|---|---|
| 1,400,518 | 12/1921 | Bovey | 165/134.1 |
| 1,533,982 | 4/1925 | Firkins | 165/134.1 |
| 1,614,580 | 1/1927 | Volckening | 165/134.1 |
| 1,631,846 | 6/1927 | Wilson | 165/134.1 |
| 1,655,031 | 1/1928 | Werra | 165/119 |
| 1,734,924 | 11/1929 | Sweitzer | 165/134.1 |
| 1,908,331 | 5/1933 | Ehrmjian | 165/134.1 |
| 2,079,380 | 5/1937 | Mummert | 165/134.1 |
| 2,325,913 | 8/1943 | McIemore, Jr. | 165/134.1 |
| 2,382,386 | 8/1945 | Arms | 165/134.1 |
| 2,399,186 | 4/1946 | Hunter | 165/134.1 |
| 2,501,147 | 3/1950 | Tolan | 165/134.1 |
| 4,057,105 | 11/1977 | Bailey | 165/119 |
| 4,271,901 | 6/1981 | Buchmuller | 165/916 |
| 4,387,764 | 6/1983 | Lister | 165/119 |
| 4,619,314 | 10/1986 | Shimoda | 165/134.1 |
| 4,696,339 | 9/1987 | Schwarz | 165/119 |
| 4,928,749 | 5/1990 | Paull | 165/119 |
| 5,558,154 | 9/1996 | Lefeber | 165/916 |
| 5,718,283 | 2/1998 | Naty et al. | 165/119 |
| 5,765,632 | 6/1998 | Gire | 165/916 |
| 5,860,470 | 1/1999 | Andersson et al. | 165/157 |

*Primary Examiner*—Ira S. Lazarus
*Assistant Examiner*—Terrell McKinnon
*Attorney, Agent, or Firm*—Evenson, McKeown, Edwards & Lenahan, P.L.L.C.

[57] ABSTRACT

An impact-resistant material protective cover is disclosed for covering a stacking-disk heat exchanger which in used in a motor vehicle as an oil/coolant cooler. The protective cover may be formed from two identical cover shells having innerengageable locking detent elements for connecting them together in position around the circumference of the cooler housing.

37 Claims, 2 Drawing Sheets

STACKING-DISK HEAT EXCHANGER

BACKGROUND AND SUMMARY OF THE INVENTION

This application claims the priority of German application 297 16 257.8, filed in Germany on Sep. 10, 1997, the disclosure of which is expressly incorporated by reference herein.

The invention relates to a stacking-disk heat exchanger, particularly an oil/coolant cooler for use in a motor vehicle, having a housing which is constructed of several stacking disks and which has connections for at least one heat transfer medium.

A stacking-disk heat exchanger of this type is known from European Patent Document EP 0 623 798 A2 in the form of an oil/coolant cooler for an internal-combustion engine. When such oil/coolant coolers are used in motor vehicles, sudden leaks could occur which resulted in the leaking-out of oil. If this leaking oil reached hot parts of the exhaust system of the internal-combustion engine, this could result in an ignition and possibly in a vehicle fire.

It is an object of the invention to provide a stacking-disk heat exchanger of the initially mentioned type which ensures a higher safety with respect to the sudden leaking of oil.

This object is achieved in that the housing is enclosed along its circumference by a protective cover consisting of an impact-resistant material. The solution according to the invention is based on the recognition that the sudden oil losses occurred particularly as the result of stone throws during the driving operation of the vehicle or the penetration of pointed objects in the event of a vehicle crash. The protective cover consisting of the impact-resistant material according to the invention reliably prevents damage to the housing and thus an emerging of oil from the housing. The protective cover can consist of a corresponding metal or of another impact-resistant material.

As a further development, the protective cover consists of a plastic material. This is a particularly advantageous development at reasonable cost which ensures reliable protection of the housing by means of simple devices.

As a further development of the invention, the protective cover consists of two shells. In a particularly advantageous manner, the two-shell design permits the subsequent mounting of the protective cover on the finished stacking-disk heat exchanger. Independently of whether the protective cover is made of one shell, two shells or several shells, according to the invention, it is detachably mounted on the circumference of the housing so that it can be mounted or demounted as required.

In a further development of the invention, both cover shells of the protective cover are provided with corresponding detent elements for the mutual connection on the circumference of the housing. In a simple manner, this achieves a form-locking interlocking of the two cover shells.

In a further development of the invention, the corresponding detent elements are molded in one piece to the two cover shells. As a result, the two cover shells can be snapped to one another without additional fastening elements in a simple manner on the circumference of the stacking-disk heat exchanger.

As a further development of the invention, both cover shells, including the respective corresponding detent elements, have an identical design. As a result, a simplified production of the protective cover is achieved because only one injection molding die is required for producing both cover shells.

As a further development of the invention, the cover shells have circumferential ribbings on their interior surfaces facing the housing which, in the mounted condition, are supported between adjacent stacking disks of the housing. This results in a supplementary form-locking securing of the cover shells on the housing.

In a further development of the invention, the cover shells are provided with reinforcing ribs on their outer circumference. This achieves an additional guarding against stone throws or the penetration of pointed objects into the stacked-disk heat exchanger.

In a further development of the invention, opposite longitudinal sides of the cover shells—viewed in the circumferential direction—are provided with concave curvatures. This results in an additional, force-locking bracing of the cover shells on the housing of the stacking-disk heat exchanger, whereby a further improved securing of the protective cover on the housing is achieved.

Other objects, advantages and novel features of the present invention will become apparent from the following detailed description of the invention when considered in conjunction with the accompanying drawings.

DESCRIPTION OF THE DRAWINGS

Figure 1:
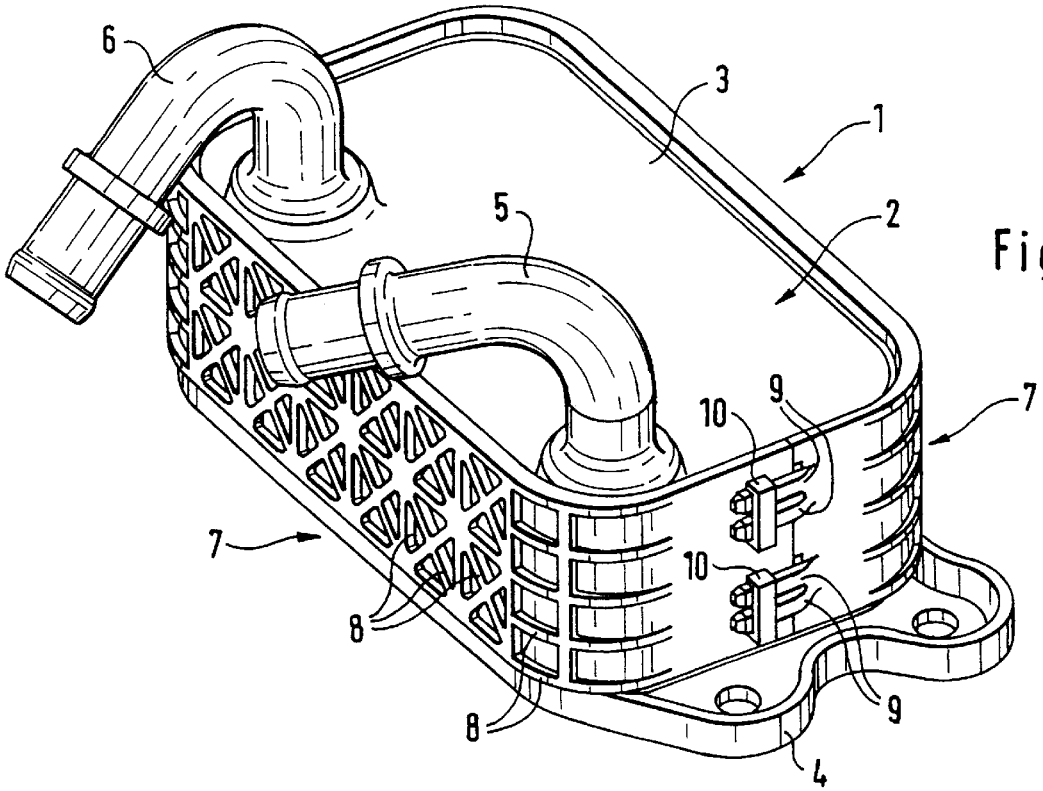
FIG. 1 is a perspective representation of an embodiment of the stacking-disk heat exchanger according to the invention in the form of an oil/coolant cooler which is provided with a protective cover.
Figure 2:
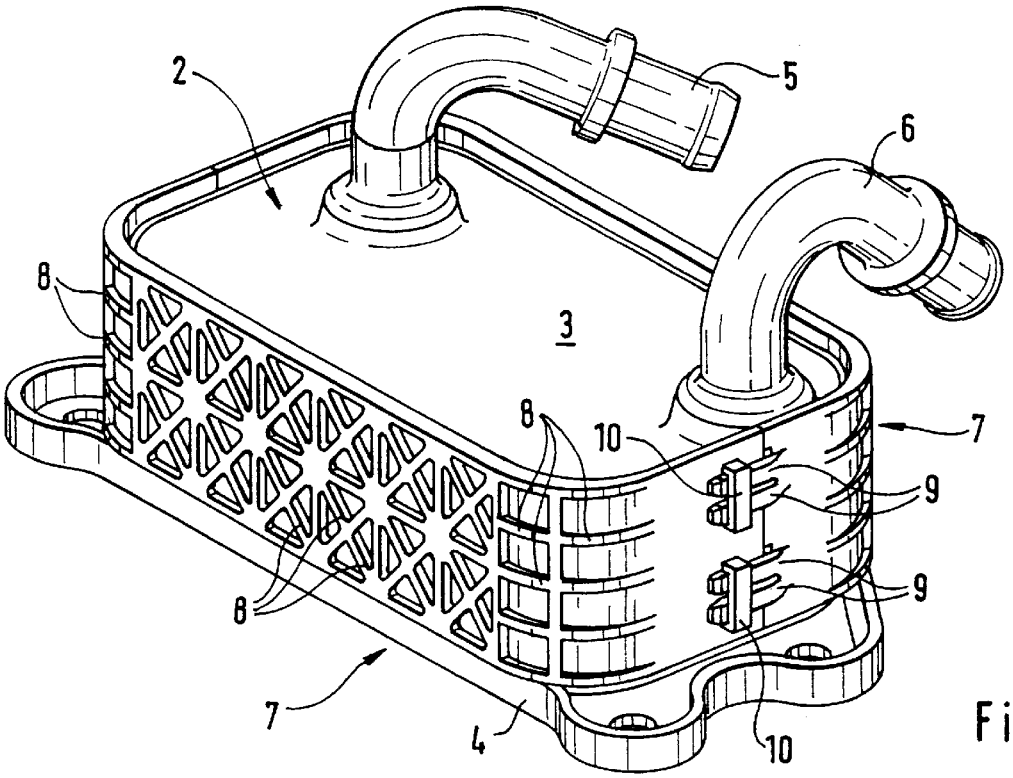
FIG. 2 is another perspective view of the stacking-disk heat exchanger according to FIG. 1.

A stacking-disk heat exchanger according to FIGS. 1 and 2 is designed as an oil/coolant cooler and is provided for use on an internal-combustion engine of a motor vehicle. The stacking-disk heat exchanger 1 is constructed in a manner known per se and has a housing 2 which is composed of several stacking disks (not shown) stacked above one another. The stacking-disk block is bounded by an upper covering disk 3 and by a lower bottom disk 4. In the area of the upper covering disk 3, connection pieces 5 and 6 are provided for a corresponding coolant. In the area of the lower bottom disk 4, corresponding connections for guiding the oil are provided in a manner which is not shown.

Figure 3:
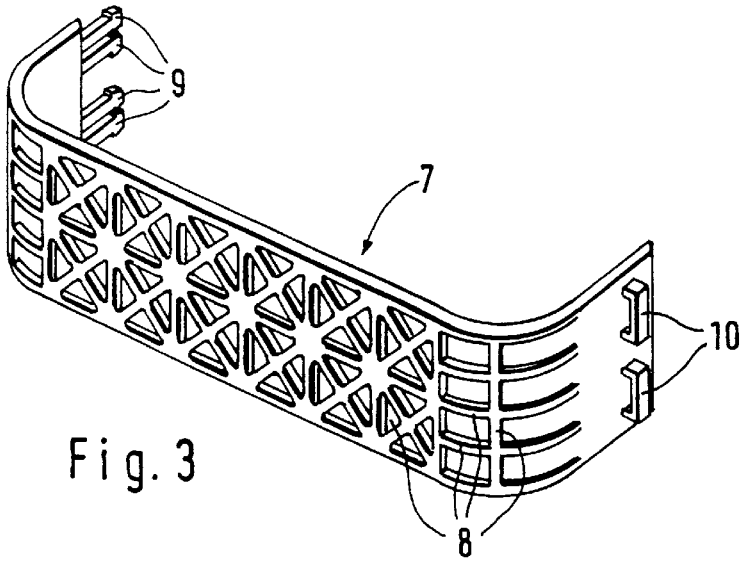
FIG. 3 is a view of one of the two cover shells of the protective cover for the stacking-disk heat exchanger according to FIGS. 1 and 2.
Figure 4:
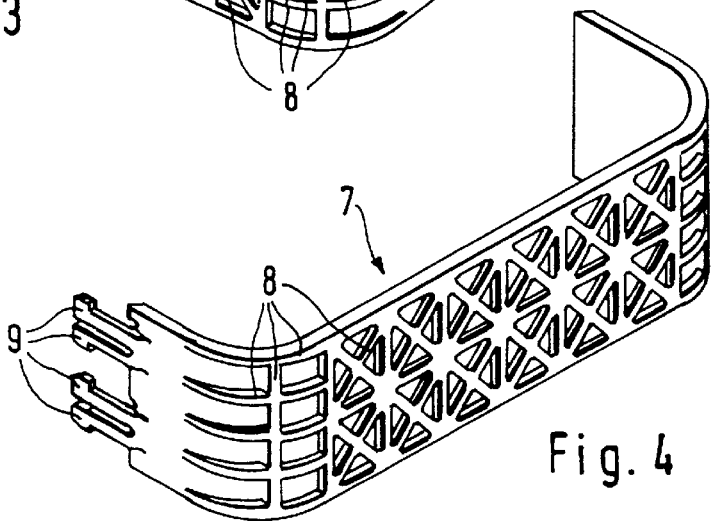
FIG. 4 is a view of another cover shell which is used as a counterpart to and has an identical construction as the cover shell according to FIG. 3.
Figure 5:
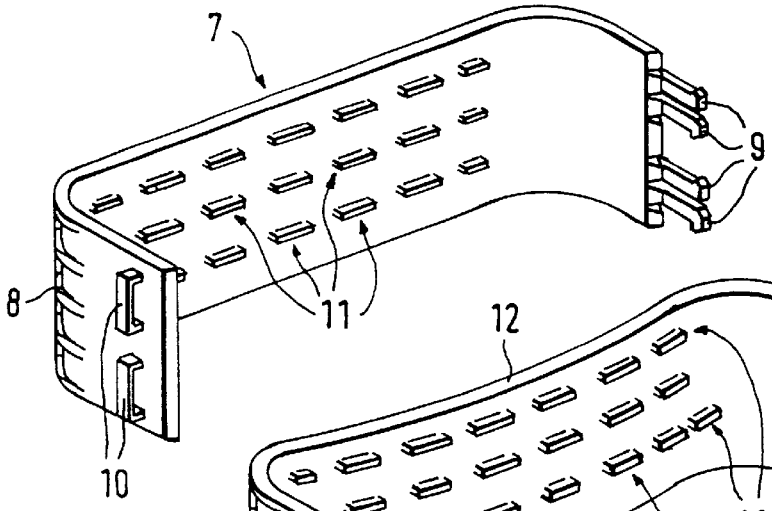
FIG. 5 is a perspective representation of the cover shell according to FIG. 3 or 4, which shows the interior surface of the cover shell.

In the area of the side edges of the stacking disks arranged above one another, the stacking-disk heat exchanger 1 is provided with a protective cover made of an impact-resistant material, which in the illustrated embodiment is a correspondingly impact-resistant plastic material. The protective cover is composed of two cover shells 7 which, according to FIGS. 3 to 5, have mutually identical mirror symmetrical designs.

Both cover shells 7 are in each case designed as band-shaped half shells with a U-shaped profile. The outer circumference of both cover shells 7 is provided with a reinforcing rib structure 8 which extends along almost the whole outer surface of each cover shell 7 and, because of the grid-type design of the reinforcing rib structure, achieves an increase of the wall thickness of each cover shell 7.

On their opposite narrow sides, the two cover shells 7 are provided with detent elements 9, 10, in which case the detent elements are constructed on one side as two pairs of detent hooks 9 arranged in parallel above one another and are constructed on the opposite side as two detent bows 10 arranged in an aligned manner above one another for receiving the pairs of detent hooks 9.

In addition, in the area of their respective longitudinal side, both cover shells 7 have on their interior surface three rows of circumferential ribbings 11 which are arranged in parallel above one another in the circumferential direction and which are aligned in parallel to the stacking disks of the stacking-disk heat exchanger 1 and, in the mounted condition, engage between individual stacking disks. This achieves an additional securing of the protective cover on the housing 2 of the stacking-disk heat exchanger 1.

For the mounting of the two cover shells on the housing 2 of the stacking-disk heat exchanger 1, the cover shells 7 are rotated about their longitudinal center axis and positioned with respect to one another so that the detent hook pairs 9 are each situated opposite the detent bows of the respective opposite cover shell. By means of a simple, axial pushing-together—also relative to the imaginary longitudinal center axis—on the housing 2, the opposite detent elements 9, 10 are locked with one another, whereby the two cover shells 7 enclose the circumference of the housing 2 in a flush manner. Also in the case of another embodiment of the invention, the two cover shells 7 are adapted such to the circumference of the respective housing of a stacking-disk heat exchanger that this circumference is enclosed in a flush manner by the cover shells.

In the case of an embodiment of the invention which is not shown, the protective cover is designed as an open, band-shaped, flexible, preferably elastically expanding ring which, after the enclosing of the respective housing, is guided together by a locking connection in the area of the front ends of the open ring. In this case, the protective cover can be designed similarly to the protective cover according to FIGS. 1 and 2, in which case the protective cover is constructed only in the area of one side not with a locking connection but with a continuous one-piece design.

Figure 6:
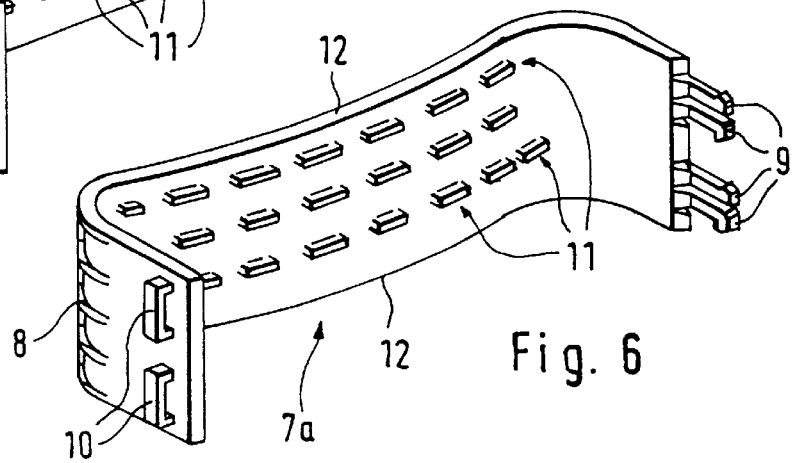
FIG. 6 is a view of another embodiment of a cover shell similar to FIGS. 3 to 5 but which is provided with a concave curvature extending in the circumferential direction.

In another embodiment of the invention, two cover shells 7*a* for a protective cover of a stacking-disk heat exchanger are provided which are similar to those of FIGS. 1 and 2 and in which both cover shells are designed according to the representation of FIG. 6. The cover shell 7*a* according to FIG. 6 has a design which is essentially identical to the cover shells according to FIGS. 1 to 5, the same components being provided with the same reference numbers. To this extent, the cover shell 7*a* does not require any further explanation. The only difference of the cover shell 7*a* is the fact that the longitudinal side according to the representation of FIG. 6 has a concave curvature 12 in the circumferential direction. These concave curvatures 12 in the case of the two cover shells 7*a*, in the locked condition of both cover shells 7*a* on the circumference of the housing of the stacking-disk heat exchanger generate a prestressing which causes an additional frictional connection between the outer circumference of the housing and the inner surfaces of the cover shells 7*a*.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Stacking-disk heat exchanger in the form of an oil/coolant cooler for use in a motor vehicle, having a housing and which is constructed of several stacking disks and which has connections for at least one heat transfer medium, wherein the housing is enclosed along its circumference by a protective cover made of an impact-resistant material.

2. Stacking-disk heat exchanger according to claim 1, wherein the protective cover consists of a plastic material.

3. Stacking-disk heat exchanger according to claim 1, wherein the protective cover has a two-shell design.

4. Stacking-disk heat exchanger according to claim 2, wherein the protective cover has a two-shell design.

5. Stacking-disk heat exchanger according to claim 3, wherein the two cover shells of the protective cover are provided with corresponding detent elements for the mutual connection on the circumference of the housing.

6. Stacking-disk heat exchanger according to claim 4, wherein the two cover shells of the protective cover are provided with corresponding detent elements for the mutual connection on the circumference of the housing.

7. Stacking-disk heat exchanger according to claim 5, wherein the corresponding detent elements are molded in one piece to the two cover shells.

8. Stacking-disk heat exchanger according to claim 7, wherein both cover shells, including the respective corresponding detent elements, have an identical design.

9. Stacking-disk heat exchanger according to claim 3, wherein, on their interior surfaces facing the housing, the cover shells have circumferential ribbings which, in the mounted condition, are supported between two adjacent stacking disks of the housing.

10. Stacking-disk heat exchanger according to claim 5, wherein, on their interior surfaces facing the housing, the cover shells have circumferential ribbings which, in the mounted condition, are supported between two adjacent stacking disks of the housing.

11. Stacking-disk heat exchanger according to claim 7, wherein, on their interior surfaces facing the housing, the cover shells have circumferential ribbings which, in the mounted condition, are supported between two adjacent stacking disks of the housing.

12. Stacking-disk heat exchanger according to claim 8, wherein, on their interior surfaces facing the housing, the cover shells have circumferential ribbings which, in the mounted condition, are supported between two adjacent stacking disks of the housing.

13. Stacking-disk heat exchanger according to claim 3, wherein the cover shells are provided with reinforcing ribs on their circumference.

14. Stacking-disk heat exchanger according to claim 5, wherein the cover shells are provided with reinforcing ribs on their circumference.

15. Stacking-disk heat exchanger according to claim 7, wherein the cover shells are provided with reinforcing ribs on their circumference.

16. Stacking-disk heat exchanger according to claim 8, wherein the cover shells are provided with reinforcing ribs on their circumference.

17. Stacking-disk heat exchanger according to claim 9, wherein the cover shells are provided with reinforcing ribs on their circumference.

18. Stacking-disk heat exchanger according to claim 3, wherein opposite longitudinal sides of the cover shells—viewed in the circumferential direction—are provided with concave curvatures, said curvatures being configured to be elastically deformed by engaging the heat exchanger housing when installed.

19. Stacking-disk heat exchanger according to claim 5, wherein opposite longitudinal sides of the cover shells—viewed in the circumferential direction—are provided with concave curvatures, said curvatures being configured to be elastically deformed by engaging the heat exchanger housing when installed.

20. Stacking-disk heat exchanger according to claim 7, wherein opposite longitudinal sides of the cover shells—viewed in the circumferential direction—are provided with concave curvatures, said curvatures being configured to be elastically deformed by engaging the heat exchanger housing when installed.

21. Stacking-disk heat exchanger according to claim 8, wherein opposite longitudinal sides of the cover shells—viewed in the circumferential direction—are provided with concave curvatures, said curvatures being configured to be elastically deformed by engaging the heat exchanger housing when installed.

22. Stacking-disk heat exchanger according to claim 9, wherein opposite longitudinal sides of the cover shells—viewed in the circumferential direction—are provided with concave curvatures, said curvatures being configured to be elastically deformed by engaging the heat exchanger housing when installed.

23. Stacking-disk heat exchanger according to claim 13, wherein opposite longitudinal sides of the cover shells—viewed in the circumferential direction—are provided with concave curvatures, said curvatures being configured to be elastically deformed by engaging the heat exchanger housing when installed.

24. Protective cover for a stacking-disk heat exchanger in the form of an oil/coolant cooler for use in a motor vehicle which includes a cooler housing surrounding stacked cooling disks, said protective cover comprising:

an impact-resistant material cover which in use circumfentially surrounds the cooler housing and prevents damage to the housing from external forces thereon during vehicle driving and collision conditions.

25. Protective cover according to claim 24, wherein the protective cover consists of a plastic material.

26. Protective cover according to claim 24, wherein the protective cover has a two-shell design.

27. Protective cover according to claim 26, wherein the two cover shells of the protective cover are provided with corresponding detent elements for the mutual connection on the circumference of the housing.

28. Protective cover according to claim 27, wherein the corresponding detent elements are molded in one piece to the two cover shells.

29. Protective cover according to claim 28, wherein both cover shells, including the respective corresponding detent elements, have an identical design.

30. Protective cover according to claim 24, wherein, on their interior surfaces facing the housing, the cover shells 7, have circumferential ribbings which, in the mounted condition, are supported between two adjacent stacking disks of the housing.

31. Protective cover according to claim 24, wherein the cover shells are provided with reinforcing ribs on their circumference.

32. Protective cover according to claim 24, wherein opposite longitudinal sides of the cover shells—viewed in the circumferential direction—are provided with concave curvatures, said curvatures being configured to be elastically deformed by engaging the heat exchanger housing when installed.

33. A stacking-disk heat exchanger assembly which in use forms an oil/coolant for a motor vehicle, comprising:

a plurality of stacking disks which are stacked one above the other, a top cover disposed above the topmost of the stacking disks, said top cover including at least one fluid connection, a bottom cover disposed below a bottommost of the stacking disks, said bottom cover including at least one fluid connection, lateral housing side walls surrounding the stacking disks and extending between and connected with the top and bottom covers, and a protective cover made of impact resistant material which encloses the lateral housing side walls and serves to protect the housing side walls from external impact forces.

34. An assembly according to claim 33, wherein the protective cover consists of a plastic material.

35. An assembly according to claim 33, wherein the protective cover has a two-shell design.

36. An assembly according to claim 35, wherein the two cover shells of the protective cover are provided with corresponding detent elements for the mutual connection on the circumference of the housing.

37. An assembly according to claim 36, wherein the corresponding detent elements are molded in one piece to the two cover shells.

* * * * *